US006327445B1

(12) United States Patent
Honda et al.

(10) Patent No.: US 6,327,445 B1
(45) Date of Patent: Dec. 4, 2001

(54) TONER IMAGE TRANSFER APPARATUS

(75) Inventors: Shin Honda; Shigeki Nishimura; Tadahiro Suzuki; Toshio Masubuchi, all of Iwatsuki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/650,667

(22) Filed: Aug. 30, 2000

(30) Foreign Application Priority Data

Dec. 14, 1999 (JP) ..... 11-354935

(51) Int. Cl.[7] ..... G03G 15/01; G03G 15/16
(52) U.S. Cl. ..... 399/45; 399/66
(58) Field of Search ..... 399/45, 44, 66, 399/81, 389, 390

(56) References Cited

U.S. PATENT DOCUMENTS 5,887,220 * 3/1999 Nagaoka ..... 399/45 X
5,905,925 * 5/1999 Kawabata et al. ..... 399/45
5,923,921 * 7/1999 OuYang et al. ..... 399/66
5,983,044 * 11/1999 Kodama et al. ..... 399/66
6,002,891 * 12/1999 Shin ..... 399/45
6,097,919 * 8/2000 Takeuchi et al. ..... 399/66 X

FOREIGN PATENT DOCUMENTS 6-340895 12/1994 (JP) .
2000-98771 * 4/2000 (JP) .

* cited by examiner

*Primary Examiner*—Sophia S. Chen
(74) *Attorney, Agent, or Firm*—Morgan, Lewis & Bockius LLP

(57) ABSTRACT

A toner image transfer apparatus for transferring a toner image formed on an intermediate transfer belt onto a recording sheet includes an environment sensor and a control panel for detecting or inputting a factor influencing the transfer of the toner image, a calculation unit for determining an initial transfer bias used for the transfer of the toner image on the basis of the above input value, and a transfer unit for inputting a correction value for correcting the initial transfer bias from the control panel and determining the corrected transfer bias on the basis of the correction value to transfer the toner image on the intermediate transfer belt onto the recording sheet by the corrected transfer bias.

10 Claims, 5 Drawing Sheets

TONER IMAGE TRANSFER APPARATUS

BACKGROUND OF THE INVENTION

1. Field of the Invention

The present invention relates a toner image transfer apparatus for transferring a toner image onto a recording sheet in an electrophotographic copying machine, a laser beam printer or the like, and more particularly to an improvement of a toner image transfer apparatus for detecting and/or inputting various factors influencing the image transfer to automatically set transfer parameters such as a transfer bias, etc. on the basis of the detection and/or input result.

2. Description of the Related Art

In a copying machine, a laser beam printer, etc. which use the electrophotographic system, a toner image corresponding to image information is formed on a photosensitive drum and then transferred onto a recording sheet, thereby forming a recording image on the recording sheet. For example, in the case of the laser beam printer, the surface of the photosensitive drum is first charged to predetermined background potential, and then exposed to a laser beam modulated on the basis of the image information to form an electrostatic latent image. Subsequently, the electrostatic latent image is developed with toner to form a toner image as a visible image, the toner image thus formed is recorded onto a recording sheet and then the recording sheet after the toner image is transferred thereto is heated and fixed by a fixer, thereby obtaining a recording image.

In order to transfer the toner image onto the recording sheet in the above recording image forming process have been known a method of directly transferring the toner image from the photosensitive drum to the recording sheet, a method of primarily transferring the toner image onto an intermediate transfer belt having an endless sheet shape and then secondarily transferring the toner image from the intermediate transfer belt to the recording sheet, etc. Of these methods, the transfer method using the intermediate transfer belt is optimum to form a full color image for which plural color toner images are required to be superposed on one another, and it is applied to a color copying machine or the like.

In all the transfer methods, transfer members such as a corona discharger, a bias roll, etc. are disposed so as to confront image carriers such as a photosensitive drum, an intermediate transfer medium, etc. through a recording sheet, and the charges having the opposite polarity to the charges of toner are applied to the back surface of the recording sheet by these transfer members, whereby a toner image is electrostatically transferred to the surface of the recording sheet. For example, when the charge polarity of toner is minus (−), a transfer bias of (+) is applied to the transfer members disposed at the back surface side of the recording sheet, and charges of (+) are applied to the back surface of the recording sheet.

Here, environmental factors such as temperature, humidity, etc. and the type of a recording sheet are considered as factors influencing the electrostatic transfer of the toner image as described above. This is because these influence factors cause variation of the resistance value of the recording sheet, and thus even when the same magnitude of transfer bias is applied, a sufficient transfer electric field cannot be produced between the image carriers and the recording sheet due to these influence factors, and thus the transfer efficiency is remarkably lowered. Further, when a bias roll is used as a transfer member, variation of the resistance value of the bias roll due to time lapse is also considered as a factor influencing the electrostatic transfer.

Therefore, the conventional toner image transfer apparatus is designed so that the type of a recording sheet onto which a toner image is transferred is input through a user interface such as an operation panel or the like by a user, and also so that an environment sensor for measuring temperature/humidity in the image forming apparatus is provided, and the magnitude of the optimum transfer bias based on the type of the recording sheet and the detected temperature/humidity is read out from a table created in advance, and then the toner image is electrostatically transferred to the recording sheet with the transfer bias thus determined. Further, in order to grasp the variation of the resistance value of the bias roll due to time lapse, the current value flowing in the bias roll when a predetermined voltage is applied to the bias roll is measured, and the transfer bias is determined in consideration of the magnitude of the current value.

However, even when the factors influencing the electrostatic transfer are detected and/or input and the transfer bias is automatically determined on the basis of these influence factors, a trouble may occur in the transfer of the image toner due to the type of the recording sheet used by the user. That is, even when the type of the recording sheet is indicated merely as "plain paper", the resistance value of the recording sheet is dispersed due to the difference of basis weight, the difference of the surface status or the like, and thus it is difficult to automatically set the transfer bias optimum to each recording sheet. Further, the table used to search the optimum transfer bias on the basis of the temperature/humidity and the type of the recording sheet cannot be extremely finely divided in view of the relationship with the cost effect, and thus the probability that the transfer bias voltage which is surely conformed with the detected temperature/humidity can be applied to the recording sheet is extremely small.

SUMMARY OF THE INVENTION

The present invention has been made in view of the above circumstances, and provides a toner image transfer apparatus which can optimize transfer parameters such as a transfer bias voltage, etc. in accordance with the real state of a recording sheet used by a user to enhance the transfer quality of the toner image to the recording sheet.

According to an aspect of the present invention, a toner image transfer apparatus for transferring to a recording sheet a toner image formed on an image carrier, includes: an influence factor detecting/inputting unit for detecting and/or inputting factors influencing the transfer of the toner image; an initial calculation unit for determining an initial transfer parameter used for the transfer of the toner image on the basis of the value from the influence factor detecting/inputting unit; a correction inputting unit to which a correction value to correct the initial transfer parameter is input; a correcting calculation unit for determining a corrected transfer parameter on the basis of the correction value thus input; and a transfer unit for transferring the toner image an the image carrier onto a recording sheet on the basis of the initial transfer parameter or the corrected transfer parameter.

According to the toner image transfer apparatus of the present invention, when influence factors such as the type of a recording sheet, the environmental temperature/humidity, and the image color type (for example, color image or monochromatic image) are detected and/or input by the influence factor detecting/inputting unit, the initial transfer parameter used to transfer a toner images for example, the magnitude of a transfer bias is determined by the initial calculation means on the basis of these influence factors. Since the initial transfer parameter is automatically determined while additionally considering various factors which seem to influence the transfer of the toner image, an excellent transfer image would be originally obtained if a toner image is transferred onto a recording sheet by using the initial transfer parameter. However, an excellent toner image may not be obtained due to the difference of the basis weight, the surface state, etc. of the recording sheet and the difference of the type of the recording sheet in the strict sense.

In this point, the toner image transfer apparatus of the present invention is equipped with the correction inputting unit for inputting the correction value of the initial transfer parameter, and it can determine the corrected transfer parameter on the basis of the correction value by the correcting calculation unit and transfer the toner image on the image carrier onto the recording sheet by using the corrected transfer parameter. Accordingly, when the transfer quality of the toner image based on the initial transfer parameter is not satisfied, a user himself/herself can operate the correction inputting unit to correct the initial transfer parameter, and transfer a toner image onto a recording sheet by using the corrected transfer parameter which is surely matched with the type of the recording sheet being used by the user, thereby obtaining a transfer toner image having excellent image quality.

Here, as the transfer parameter may be used a transfer bias to be applied between the recording sheet and the image carrier, the press force of the recording sheet against the image carrier or the like. From the viewpoint of enabling the magnitude to be easily adjusted, the transfer bias is preferably used as the transfer parameter.

Further, as the correction inputting unit is preferably used a member through which a user can easily input the correction value of the initial transfer parameter without resistance. For example, it is preferable to use such a style that by using a user interface such as an operation panel a personal computer or the like, the user can select one of correction levels of plural stages which are located at higher and lower level sides with respect to the initial set parameter level. In addition even when the same correction level is input from the correction inputting unit, the effectiveness of the correction might be varied if the type of the recording sheet is varied. Therefore, it is preferable that the correction amount of the initial transfer parameter is varied in accordance with the type of the recording sheet onto which the toner image is transferred even when the correction value of the same level is input from the correction inputting unit.

BRIEF DESCRIPTION OF THE DRAWINGS

A preferred embodiment of the present invention will be described in detail based on the following figures, wherein.

DETAILED DESCRIPTION OF THE PREFERRED EMBODIMENT

A preferred embodiment according to the present invention will be described hereunder with reference to the accompanying drawings.

Figure 1:
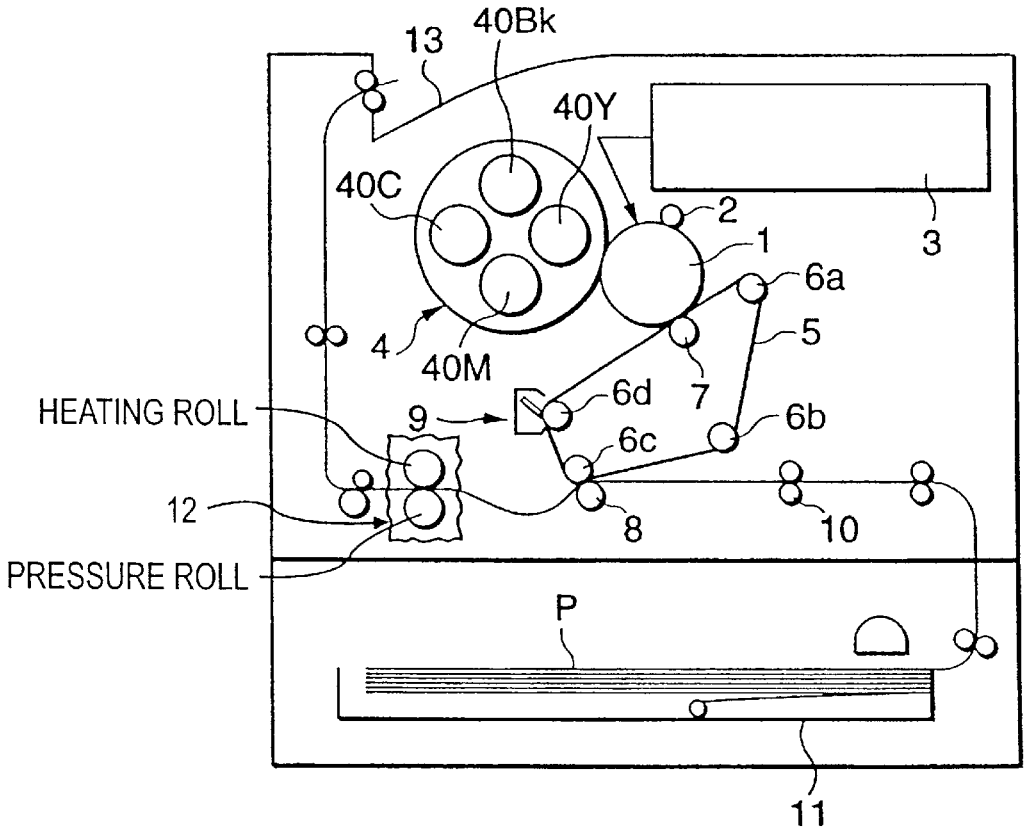
FIG. 1 is a diagram showing the construction of a color laser beam printer to which the present invention is applied.

FIG. 1 shows an embodiment of a color laser beam printer to which the present invention is applied.

In FIG. 1, reference numeral 1 represents a photosensitive drum serving as an image carrier, reference numeral 2 represents a charging roll for charging the surface of the photosensitive drum 1 in advance, reference numeral 3 represents a laser beam scanner for writing an electrostatic latent image onto the photosensitive drum 1 charged by the charging roll 2, and reference numeral 4 represents a rotary developing unit containing four developers 40Bk, 40Y, 40M, 40C in which respective toner images of black (Bk), yellow (Y), magenta (M), cyan (C). The four developers 40Bk, 40Y, 40M, 40C are disposed in the rotary developing unit so as to be freely rotatable and suitably and selectively switched.

Reference numeral 5 represents an intermediate transfer belt which is suspended under tense by plural feeding rolls 6*a* to 6*d*. Respective color toner images which are successively formed on the photosensitive drum 1 are transferred onto the intermediate transfer belt 5 while multiplexed with one another, and then collectively secondarily transferred from the intermediate transfer belt 5 onto a recording sheet P. Reference numeral 7 represents a primary transfer roll for electrostatically transferring each toner image onto the intermediate transfer belt 5, reference numeral 8 represents a secondary transfer roll for electrostatically transferring each toner image onto the recording sheet P, and reference numeral 9 represents a belt cleaner for cleaning paper powder or toner adhering to the intermediate transfer belt 5.

Further, reference numeral 10 represents a registration roll for feeding a recording sheet P supplied from a sheet supply cassette 11 to a secondary transfer position for the toner image at a predetermined timing. For example when a full color image is formed on the recording sheet P, all of four color toner images are primarily transferred onto the intermediate transfer belt 5, and then the recording sheet P is fed to the secondary transfer position at which the secondary transfer roll 8 is disposed.

Reference Numeral 12 represents a heating fixer for passing therethrough a recording sheet P onto which a toner image is transferred and heating and fixing the unfixed toner image on the recording sheet P. The heating fixer 12 is constructed by a heating roll containing a heater and a pressure roll disposed so as to be pressed against the heating roll.

In the color laser beam printer of this embodiment thus constructed, the laser beam scanner 3 exposes the photosensitive drum 1 to light on the basis of image information, and an electrostatic latent image corresponding to yellow Y is written onto the photosensitive drum 1. In the rotary developing unit 4, the yellow developer 40Y is set so as to confront the photosensitive drum 1, and the electrostatic latent image is developed by the yellow developer 40Y with some time lag from the writing timing. The toner image of yellow Y thus formed is primarily transferred onto the intermediate transfer belt 5 by the primary transfer roll 7, and the intermediate transfer belt 5 is rotated while carrying the toner image thereon. The exchange of the developer is carried out during the time period from the time when the developing step of the yellow developer 40Y is completed until the one-cycle rotation of the intermediate transfer belt 5 is finished. That is, the magenta developer 40 M is set so as to confront the photosensitive drum 1 by 90° rotation of the rotary developing unit 4.

Subsequently, the above operation is repeated every one rotation cycle of the intermediate transfer belt 5, and the toner images of magenta M, cyan C and black Bk are successively transferred from the photosensitive drum 1 to the intermediate transfer belt 5 every time the above operation is carried out. Finally, four color toner images are superposed on the intermediate transfer belt 5 to form a superposed toner image. The multiplex-transfer color toner image thus formed is secondarily transferred onto the recording sheet P fed from the registration roll 10 at a predetermining timing, and the recording sheet P onto which the unfixed toner image is transferred is passed through the heating fixer 12 and then discharged to a discharge tray 13.

Figure 2:
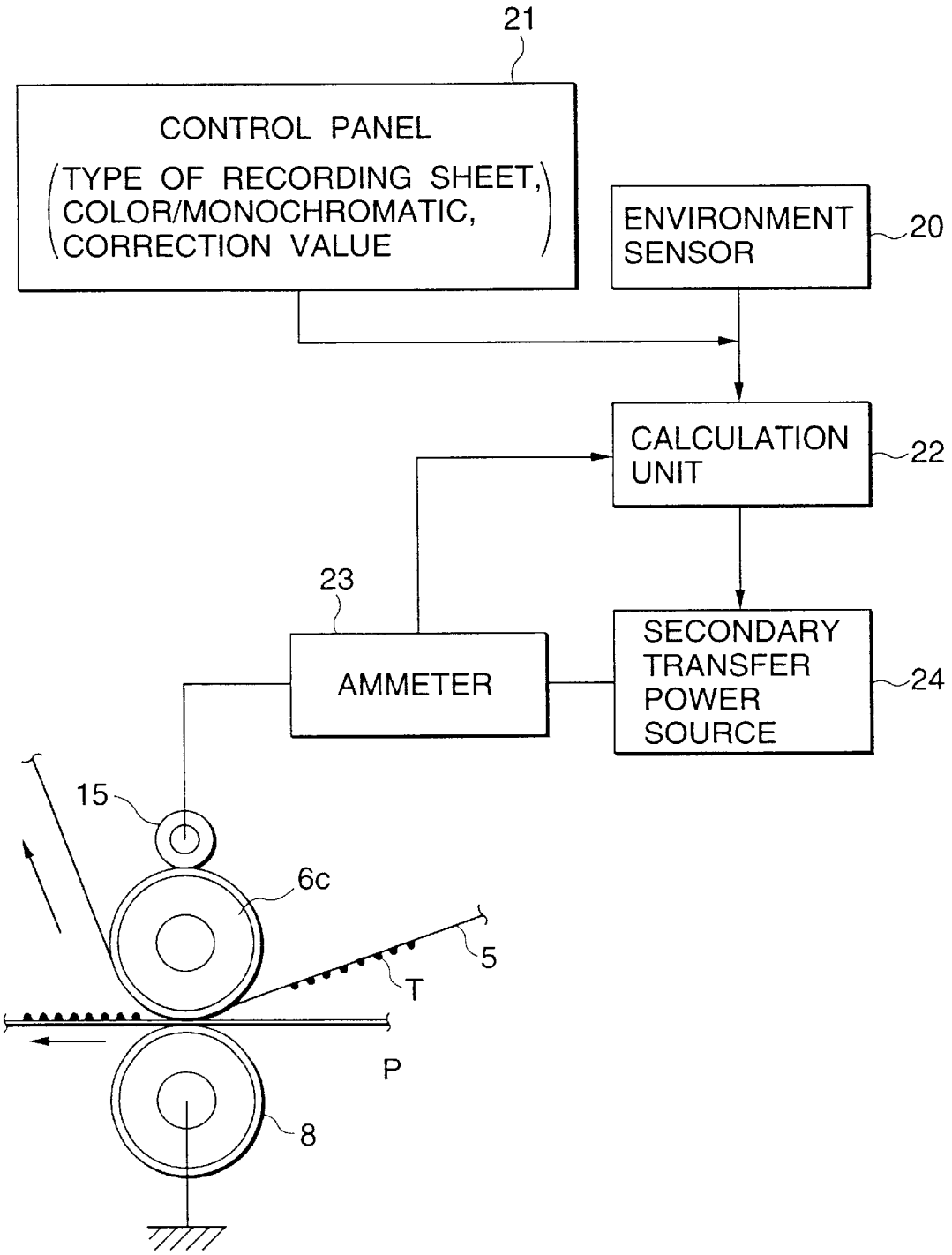
FIG. 2 is a block diagram showing the construction of a secondary transfer system according to an embodiment of the present invention.

FIG. 2 is a block diagram showing the construction of the secondary transfer unit for transferring the toner image from the intermediate transfer belt 5 to the recording sheet P.

A feeding roll 6*c* which is disposed so as to confront the secondary transfer roll 8 through the intermediate transfer belt 5 is formed by coating the surface of an insulating roll with a semiconductive sheet, and a conductive contact roll 15 to which a predetermined transfer bias is applied abuts against the surface of the feeding roll 6*c*. Accordingly, when a transfer bias having the same polarity as the toner image is applied to the contact roll 15 to provide charges to the surface of the feeding roll 6*c*, a transfer electric field is formed between the transfer roll 8 located at the back surface side of the recording sheet P and the feeding roll 6*c* located at the back surface side of the intermediate transfer belt 5, and the toner image T held on the intermediate transfer belt 5 is electrostatically transferred onto the recording sheet P.

In order to excellently transfer the toner image T onto the recording sheet P with a constant transfer efficiency, it is necessary to form a transfer electric field having constant intensity between the transfer roll 8 and the feeding roll 6*c*. However, when the resistance value of the recording sheet P passing between the rolls 8 and 6*c* varies, the intensity of the transfer electric field also varies. Since the resistance value of the recording sheet P is greatly effected by the water content, there is such a tendency that the cardboard having a larger basis weight has a lower resistance value than plain paper. Further, there is also such a tendency that OHP film which hardly absorb water has a higher resistance value than plain paper. Accordingly, the transfer of the toner image T is influenced by the type of the recording sheet P and the temperature/humidity in the printer, and thus it is reasonable to consider these factors as influence factors to the transfer of the toner image T.

In order to press the recording sheet P against the intermediate transfer belt 5 with a predetermined nip width to enhance the transfer efficiency, the periphery of the transfer roll 8 which is brought into contact with the back surface side of the recording sheet P is covered by an elastic layer which is adjusted in resistivity. However, since a high voltage is applied to the transfer roll 8, the resistance value of the transfer roll 8 is varied with time lapse, so that the intensity of the transfer electric field as described above is influenced. That is, the resistance value of the transfer roll 8 which varies with time lapse is considered as an influence factor to the transfer of the toner image T.

Further, when a toner image to be transferred onto the recording sheet P is a full color image including four color toner images of yellow, magenta, cyan and black, a further higher transfer electric field is required as compared with a case where a monochromatic image including only a black toner image is transferred to the recording sheet P. That is, the difference between the full color image and the monochromatic image is also considered as an influence factor to the transfer of the toner image T.

In order to an excellent transfer toner image at all times irrespective of the variation of these influence factors, in the printer of this embodiment, the variation of these influence factors are detected by a sensor or input by a user and the optimum transfer bias is derived on the basis of the detection or input value. Specifically, as shown in FIG. 2, the temperature/humidity in the housing of the printer is measured by an environment sensor 20, and the type of the recording sheet P and the selection of color print/monochromatic print which are associated with the print job are carried out from a control panel 21 of the printer or a computer terminal outputting a print instruction by the user. In order to detect the variation of the resistance value of the secondary transfer system containing the transfer roll 8, a constant voltage is applied from a secondary transfer power source 24 to the contact roll 15 when a main power source of the printer in which the print job has not yet been started is turned on, and the current value flowing between the contact roll 15 and the transfer roll 8 is measured by an ammeter 23, whereby the resistance value of the secondary transfer system at that time is derived. On the basis of the information thus derived, a calculation unit 22 determines the magnitude of the optimum transfer bias every print job, and this value is set in the secondary transfer power source 24, whereby the secondary transfer of the toner image from the intermediate transfer belt 5 to the recording sheet P is carried out by the transfer bias.

The calculation unit 22 refers to a table which is stored in ROM of the printer in advance, and derives the optimum transfer bias on the basis of the type of the recording sheet P, the image color type (i.e., one of full color image and monochromatic image) and the resistance of the secondary transfer system.

Figure 3:
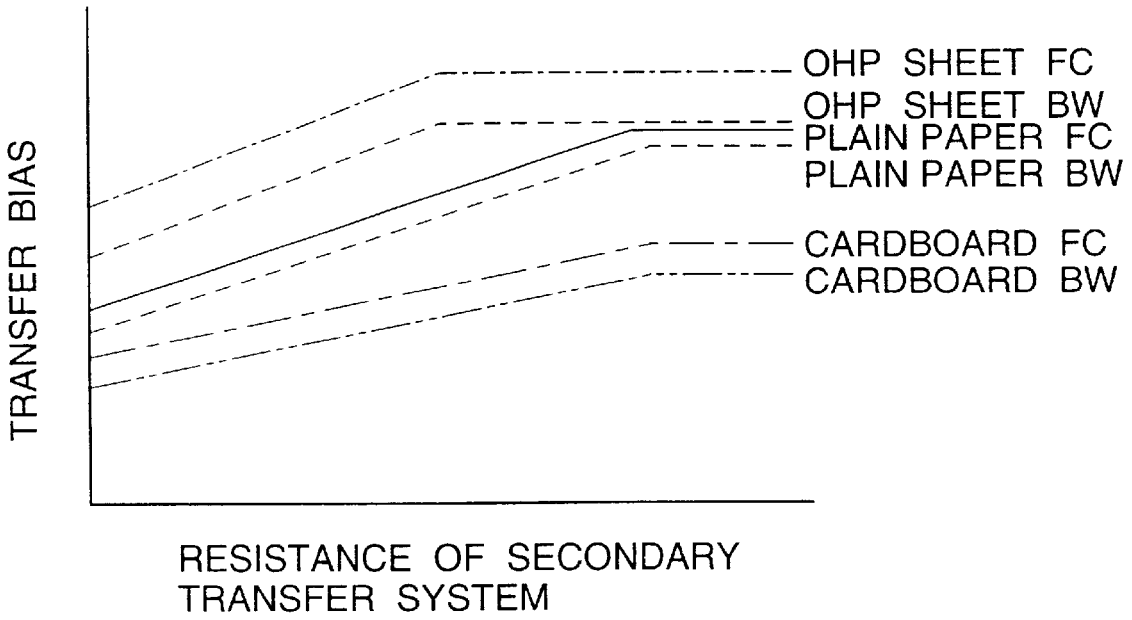
FIG. 3 is a graph for determining a secondary transfer bias on the basis of the resistance of the secondary transfer system, the type of a recording sheet and a print mode.

FIG. 3 is a graph showing the above table. The abscissa of the graph represents the resistance of the secondary transfer system, and the ordinate of the graph represents the transfer bias. More specifically, this graph shows the relationship between the transfer bias and the secondary transfer system resistance for six samples which are different in at least one of the type of the recording sheet P and the image color type. In the graph, "FC" represents the fill color image, and "BW" represents the monochromatic image.

Even when the type of the recording sheet P is "plain paper", plural kinds of sheets exist for "plain paper" due to the difference of makers. This means that by inputting only the difference in the type of the recording sheet P (for example, "plain paper", "cardboard" or "OHP sheet"), it is difficult to obtain the transfer bias which is surely matched with the recording sheet P being used. Therefore, the printer of this embodiment is designed so that a user can correct the secondary transfer bias value by himself/herself when the user judges that a high-quality secondary transfer image cannot be obtained by using even a transfer bias which is automatically determined by the calculation means 22.

That is, when the user does not satisfy a recording image obtained on a recording sheet P through a print job, the user can shift the print mode of the printer to the image quality adjusting mode by operating the control panel. In this case, as shown in FIG. 4, an indication representing the image quality adjusting mode is displayed on a display portion 26 of the control panel 25. In the image quality adjusting mode, one of five-step correction levels can be selected. For example, "level 3" is set as an initial value, and two higher correction levels (level 4, level 5) and two lower correction levels (level 2, level 1) than the level 3 are set. Any one of these correction levels can be selected. When "level 3" is set as the initial value, the transfer bias which is automatically determined by the calculation unit is used in "level 3". In "level 4" or "level 5", a transfer bias higher than that of the level 3 is used. On the other hand, in "level 2" or "level 1", a transfer bias lower than that of the level 3 is used.

Figure 5:
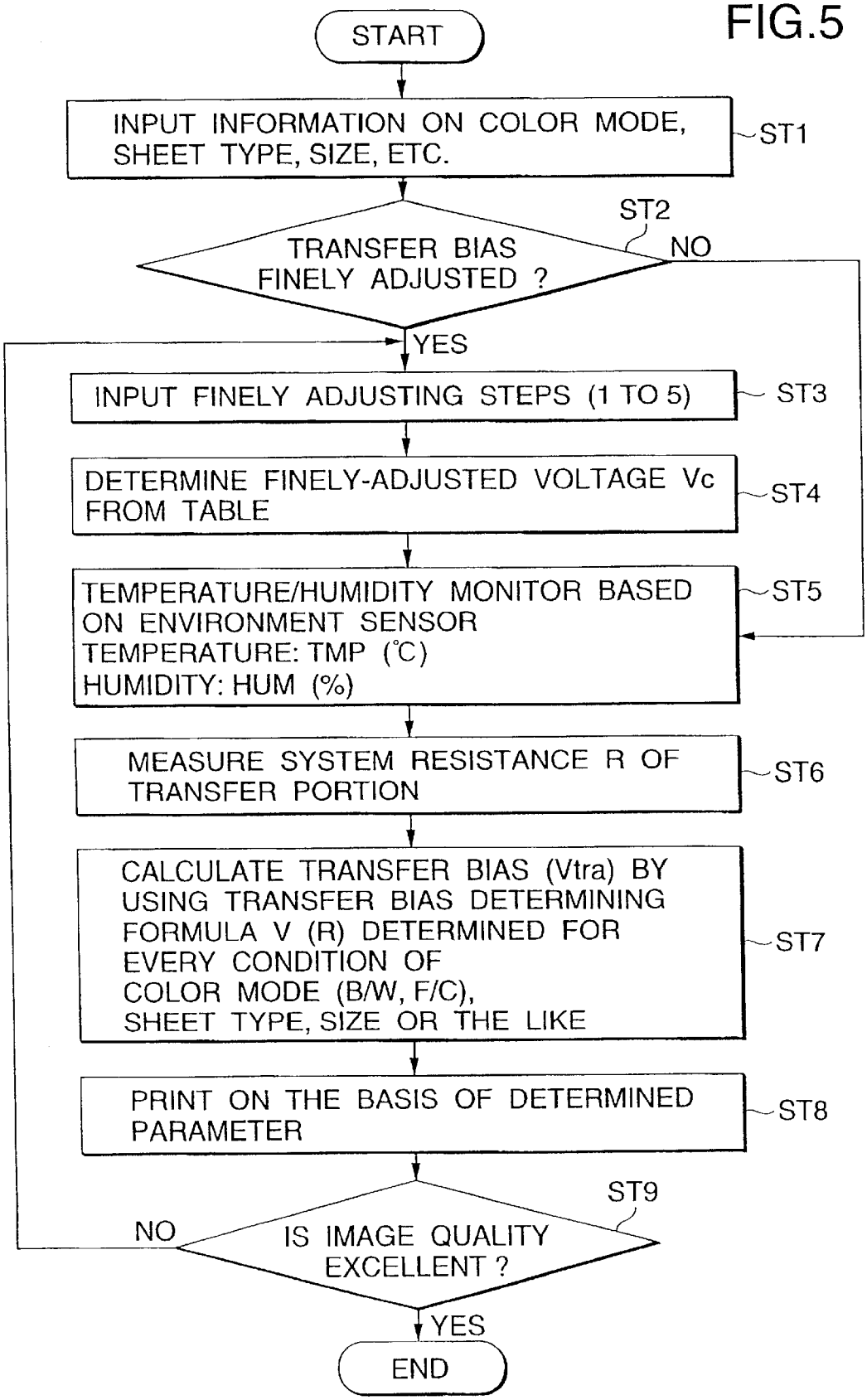
FIG. 5 is a flowchart showing the procedure of determining a secondary transfer bias.

FIG. 5 is a flowchart showing the procedure of determining the transfer bias in the printer of this embodiment.

First, the user inputs information on the type and size of the recording sheet used in the print job and the type of the color mode from the control panel 25 (ST1). Subsequently, it is judged in step 2 (ST2) that the image quality adjusting mode is not selected, the processing goes to step 5 (ST5). The calculation unit 22 takes from the environment sensor 20 information on temperature and humidity in the printer (ST5), measures the resistance value R of the secondary transfer system on the basis of the value of the ammeter 23 (ST6) and then determines the secondary transfer bias on the basis of the above information by using the graph shown in FIG. 3 (ST7). The actual print of a recording image is carried out by using the secondary transfer bias thus determined (ST8), and when the user dissatisfies the image quality of the recording image, he/she can set the mode of the printer to the image quality adjusting mode (ST9).

Figure 4A:
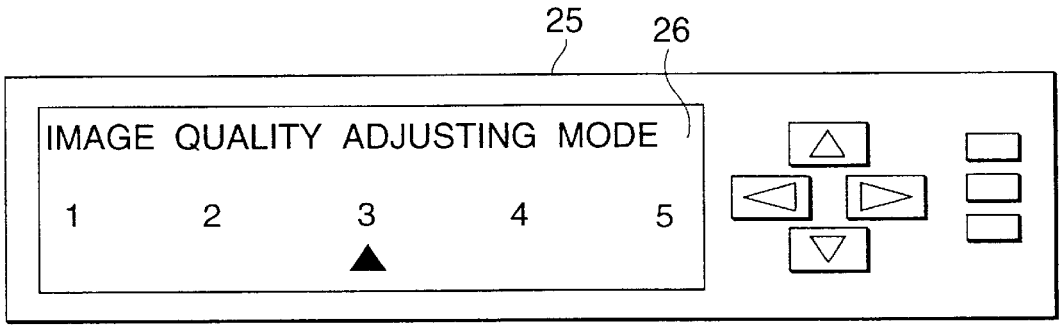
FIGS. 4A and 4B are diagrams showing a control panel which is set to an image quality adjusting mode.
Figure 4B:
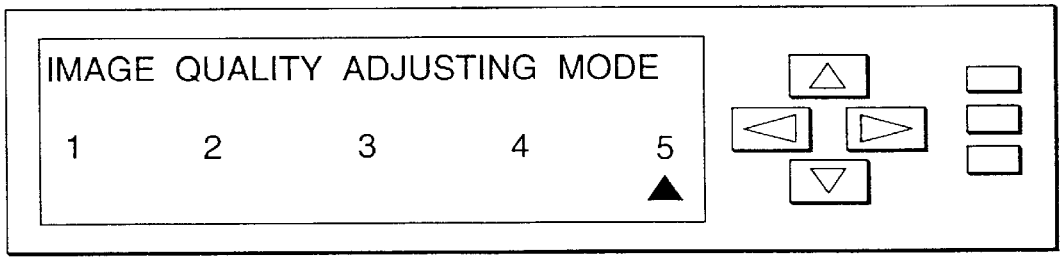

In the image quality adjusting mode, a correction level is selected in accordance with the display of the control panel 25 shown in FIGS. 4A and 4B (ST3), and a finely adjusted voltage Vc matched with the correction level selected by the user is determined in the calculation unit 22 (ST4). At this time, the adjustment range of the finely-adjusted voltage Vc is varied in accordance with the type of the recording sheet P. For example, in the case of the comparison between the OHP sheet and the cardboard, if the transfer bias to be applied is varied by the same value, the effectiveness to the variation of the transfer bias is smaller in the former than in the latter. Therefore, if the transfer bias is not varied by a larger value in the former than that in the latter, the improvement of the transfer quality at the same level cannot be achieved in the former. Accordingly, when the correction level is varied from "level 3" to "level 4", the value of the finely-adjusted voltage Vc for plain paper is larger than that for cardboard, and also the value of the finely-adjusted voltage Vc for OHP sheet is larger than that for plain paper.

The calculation unit adds the transfer bias determined in the graph of FIG. 3 with the finely-adjusted voltage Vc determined in ST4, and sets the result as a secondary transfer bias in the secondary transfer power source. Accordingly, the secondary transfer bias which is surely matched with the type of the recording sheet in the strict sense can be determined on basis of the user's intention, and the transfer quality of the toner image to the recording sheet can be enhanced. Further, since the image quality adjusting mode based on the user's input is provided in the printer as described above, when a trouble such as a transfer failure frequently occurs in some specific recording sheet, the user can surely correct the transfer bias by receiving a notification on the information on the image quality adjusting level for the recording sheet from a printer shop or a service engineer side. Therefore, a high-quality transfer image can be obtained without a service engineer making a business trip for an adjustment work.

In this embodiment, the secondary transfer bias is selected from the transfer parameters, and the user finely adjusts this transfer bias. However, this embodiment may be modified such that a mechanism of making variable the press force of the secondary transfer roll against the intermediate transfer belt is provided and the user finely adjusts the press force.

As described above, according to the toner image transfer apparatus of the present invention, when a user dissatisfies the transfer quality of a toner image based on the initial transfer parameter which is automatically determined by the apparatus, the user can operate the correction input unit to correct the initial transfer parameter by himself/herself, and the toner image can be transferred onto the recording sheet on the basis of the corrected transfer parameter which is surely matched with the type of the recording sheet being used by the user. Therefore, the transfer parameter such as the transfer bias voltage or the like can be optimized in accordance with the actual state of the recording sheet used by the user, whereby the transfer quality of the toner image to the recording sheet can be enhanced.

What is claimed is:

1. A toner image transfer apparatus for transferring to a recording sheet a toner formed on an image carrier, comprising:

an influence factor detecting/inputting unit that detects and/or inputs a factor influencing the transfer of the toner image;

an initial calculation unit that determines an initial transfer parameter used for the transfer of the toner image on the basis of a value detected and/or input by the influence factor detecting/inputting unit;

a correction inputting unit to which a correction value to correct the initial transfer parameter is input;

a correcting calculation unit that determines a corrected transfer parameter on the basis of the correction value thus input; and a transfer unit that transfers the toner image on the image carrier onto a recording sheet on the basis of the initial transfer parameter or the corrected transfer parameter, wherein both the transfer parameters are a transfer bias to be applied between the recording sheet and the image carrier.

2. The toner image transfer apparatus as claimed in claim 1, wherein the input of the correction value by the correction inputting unit is carried out by setting the initial transfer parameter as a reference value and stepwisely increasing/reducing the reference value.

3. The toner image transfer apparatus as claimed in claim 1, wherein a correction amount of the initial transfer parameter by the correcting calculation unit is varied in accordance with the type of the factor influencing the transfer of the toner image.

4. The toner image transfer apparatus as claimed in claim 1, wherein a correction amount of the initial transfer parameter by the correcting calculation unit is varied in accordance with the type of the recording sheet onto which the toner image is transferred.

5. A toner image transfer apparatus for transferring a toner image formed on an image carrier onto a recording sheet, comprising:

an initial calculation unit which is supplied with a factor influencing the transfer of the toner image and determines an initial transfer parameter used for the transfer of the toner image;

a correcting calculation unit which is supplied with a correction value for correcting the initial transfer parameter and determines a corrected transfer parameter; and a transfer unit that transfers the toner image on the image carrier onto a recording sheet on the basis of the initial transfer parameter or the corrected transfer parameter, wherein both the transfer parameters are a transfer bias to be applied between the recording sheet and the image carrier.

6. The toner image transfer apparatus as claimed in claim 5, wherein the input of the correction value for correcting the initial transfer parameter is carried out by setting the initial transfer parameter as a reference value and stepwisely increasing/reducing the reference value.

7. The toner image transfer apparatus as claimed in claim 5, wherein a correction amount of the initial transfer parameter by the correcting calculation unit is varied in accordance with the type of the factor influencing the transfer of the toner image.

8. The toner image transfer apparatus as claimed in claim 5, wherein the correction value of the initial transfer parameter by the correcting calculating unit is varied in accordance with the type of the factor influencing the transfer of the toner image.

9. The toner image transfer apparatus as claimed in claim 5, wherein a correction amount of the initial transfer parameter by the correcting calculation unit is varied in accordance with the type of the recording sheet onto which the toner image is transferred.

10. The toner image transfer apparatus as claimed in claim 5, wherein the correction value of the initial transfer parameter by the correcting calculation unit is varied in accordance with the type of the recording sheet onto which the toner image is transferred.

* * * * *